US008939120B1

(12) United States Patent
Meneguzzi et al.

(10) Patent No.: US 8,939,120 B1
(45) Date of Patent: Jan. 27, 2015

(54) LASER IGNITION OF HIGH PRESSURE COMBUSTIBLE GAS MIXTURES IN A PRESS

(75) Inventors: Maurice M. Meneguzzi, Manassas, VA (US); Dannis W. Massey, Manassas, VA (US); David L. Kruczynski, Manassas, VA (US)

(73) Assignee: Utron Kinetics, LLC, Manassas, VA (US)

( * ) Notice: Subject to any disclaimer, the term of this patent is extended or adjusted under 35 U.S.C. 154(b) by 968 days.

(21) Appl. No.: 13/069,493

(22) Filed: Mar. 23, 2011

Related U.S. Application Data

(60) Provisional application No. 61/340,842, filed on Mar. 23, 2010.

(51) Int. Cl.
*F23Q 7/00* (2006.01)

(52) U.S. Cl.
USPC ..... 123/145 A; 123/591

(58) Field of Classification Search
USPC ..... 123/46 SC, 143 B, 145 A, 169 R, 591, 123/592; 431/1; 372/10, 11, 92, 99, 101, 372/109
See application file for complete search history.

(56) References Cited

U.S. PATENT DOCUMENTS

| | | | | |
|---|---|---|---|---|
| 5,367,869 | A * | 11/1994 | DeFreitas | 60/776 |
| 7,040,270 | B2 * | 5/2006 | Herdin et al. | 123/143 B |
| 7,699,033 | B2 * | 4/2010 | Bihari et al. | 123/143 B |
| 7,765,980 | B2 * | 8/2010 | Vogel et al. | 123/305 |
| 2004/0216712 | A1 * | 11/2004 | Herdin et al. | 123/143 B |
| 2008/0098973 | A1 * | 5/2008 | Niwa et al. | 123/143 B |
| 2008/0264371 | A1 * | 10/2008 | Taido et al. | 123/143 B |
| 2009/0133655 | A1 * | 5/2009 | Inohara et al. | 123/143 B |
| 2009/0159031 | A1 * | 6/2009 | Gruber | 123/143 B |

* cited by examiner

*Primary Examiner* — John Kwon
*Assistant Examiner* — Johnny H Hoang
(74) *Attorney, Agent, or Firm* — James Creighton Wray

(57) ABSTRACT

A chamber is pressurized with a natural gas and air mixture. The pressure moves a piston and die to compress material to be formed into a part. The pressurized gas and air mixture is ignited with a laser beam focused with a lens or collimator into a point or fine line in a center of the chamber. Rapid combustion of the gas and air mixture drives the piston and die, compacting the part into a net shape. The focused laser beam centrally ignites pressurized gas and air mixture providing controlled combustion in the chamber and preventing damaging detonation. The focused point beam is used in chambers having length to diameter L/D aspect ratio of 2 or less than 2. The collimated thin beam is used in chambers having L/D greater than 2.

17 Claims, 3 Drawing Sheets

LASER IGNITION OF HIGH PRESSURE COMBUSTIBLE GAS MIXTURES IN A PRESS

This application claims the benefit of U.S. Provisional Application No. 61/340,842, filed Mar. 23, 2010, which is hereby incorporated by reference in its entirety.

SUMMARY OF THE INVENTION

The present invention uses a laser beam to ignite a gas mixture in the combustion chamber of a high power press. The laser beam ignition avoids drawbacks of previous systems, which involved spark plugs or glow plugs inside the chamber. Those devices were damaged by the high pressure and temperature of combustion. By focusing the laser beam ignition at the center of the chamber or along its axis the invention avoids detonations which tend to occur when combustion starts at one end of an elongated chamber.

One of the specialties of UTRON is dynamic compaction of metal and ceramic powders. Utron's Combustion Driven Compaction process (CDC) utilizes the controlled release of energy from combustion of natural gas and air to compact powders at higher pressures (up to 150 ton/si) than possible by traditional means with a gentler loading rate. In operation the following steps occur. (1) The chamber is filled to high pressure with a mixture of natural gas and air. (2) As the chamber is being filled, the piston or, ram is allowed to move down, pre-compressing and removing entrapped air from the powder. (3) The gas supply is closed and an ignition stimulus is applied, causing the pressure in the chamber to rise dramatically and further compressing the metal powder to its final net shape. The CDC process is based on utilizing the direct conversion of chemical energy by controlled combustion to produce compaction.

To ignite a gas mixture, several methods have been used, such as spark plugs or glow plugs. We previously used a glow plug igniter at the top of the combustion chamber. All these devices survive with difficulty at the very high pressures (thousands of atmospheres) and temperatures (around 3000 K) that occur in the combustion chamber.

Laser ignition by concentrating the light at one point to produce a spark has been used successfully to replace spark plugs in automobile engines. In those systems, the focal point was very close to the laser window. In the case of large combustion chambers, igniting a gaseous mixture at one end of the chamber might give a resulting propagating flame enough space to undergo a transition from a controlled combustion to a detonation. A different arrangement is needed to avoid detonations, which are dangerous to the equipment. The pressures in a CDC press chamber are at least one order of magnitude higher than what is encountered in engines.

This invention uses a laser beam as a non intrusive ignition device. Two versions of the new laser ignition system are used.

In the first ignition system, using a lens behind the laser window, the light is concentrated at one point to create a very high temperature to initiate ignition at the point. The lens is chosen so that the position of the ignition initiating point is in the center of the chamber. This minimizes the risk of transition from combustion to detonation, at least when the ratio L/D of the length of the chamber versus its diameter is not too large. Independently of the ignition method, it was found empirically that L/D larger than one can lead to detonations if ignition occurs at one end of the chamber. If ignition starts at the center, L/D must be smaller than 2.

In the second ignition system, for any chamber and especially for an elongated chamber, with L/D larger than 2, a collimator is used to reduce the diameter of a laser beam directed axially in the chamber. The narrow laser beam concentrates the laser beam energy on the whole axis of the chamber, rather than at one point. Ignition will then start either at several points or everywhere along the axis. This is what is needed to avoid any detonation.

One laser suitable for use is a Q-switched Nd:YAG infrared laser with wavelength of 1064 nm. The pulse energy is 200 mJ or more, with a pulse duration less than 10 ns.

Laser energy requirements vary with the press configuration and the combustible mixture used. The ignition sequence is similar, however. A pulsed laser is preferred to a continuous laser, because of the turbulence due to the rapid filling of the chamber. Indeed, a continuous laser with lower power would spread the heat over many different molecules of the moving fluid instead of concentrating all the energy on a smaller number of molecules. Concentrating the ignition energy is what one short pulse does, since the fluid cannot move significantly in 10 ns. A much higher ignition temperature thus is obtained in a very small volume.

The laser beam enters the gas filled combustion chamber through a thick sapphire window. This window is constructed to withstand the high pressures and temperatures produced by the combustion. A lens is mounted before the window for focusing the beam and initiating ignition at one point in the chamber. For producing a long thin laser beam a collimator is mounted between the laser source and the window to reduce the beam diameter in the case of providing ignition along the beam.

When using a collimated beam in the chamber, two potential problems must be avoided at the other end of the chamber with respect to the window. On the one hand, the light must not return to the laser source, which could be damaged. On the other hand, the invention must avoid hot spots on the metallic walls, which again could start combustion at one end of the chamber and produce detonations. Therefore, an absorbing surface or a diffusive one must be placed, in a position opposite the laser source.

Deposits on the chamber side, of the window could in principle reduce the energy of the laser beam and even prevent ignition. However, experiments show that the system is self-cleaning, because the laser burns the layer of particles deposited on the window.

The repletion rate of the laser is 10 Hz, much higher than that of the press, which will operate at around 6 times/min. So there is no waiting time for the laser ignition when the chamber is filled.

The same laser can be used in the UV range instead of the infrared, if a frequency converter is added. This is a different ignition method, in which the photons, do not heat the gas but dissociate molecules, creating a population of radicals which can initiate the reactions at lower temperatures.

A combustion driven compaction press has a combustion chamber and a piston in and extending from the chamber. A die connects to an end of the piston remote from the chamber. Gas and air inlets fill and pressurize the chamber with a gas and air mixture, which moves the piston and die to initially compress a part. A laser source, spaced from the chamber projects a laser beam. An optical device optically aligned with the laser source directs and focuses the laser beam toward a center of the chamber. A window in the chamber opposite the piston admits the focused and directed laser beam into the chamber. Ignition and combustion of the gas and air mixture in the chamber drives the piston and die outward to compact the part to near net shape.

One form of the optical device is a lens for focusing the laser beam to a focal point in a center of the chamber. In another form, a collimator focuses the laser beam in a fine line on a center of the chamber. The chamber is a cylindrical chamber.

A light absorber or a light diffuser on the piston in the chamber opposite the window absorbs energy of the laser beam, or diffuses the laser beam and prevents retro reflection of the laser beam through the window. This prevents ignition of the gas and air mixture elsewhere than in the center of the chamber.

In one form the laser source provides a laser beam that intensely heats the gas and air mixture. The focus ignites the gas and air mixture and starts the combustion. In one form the laser beam produces photons that do not heat the gas but disassociates molecules and creates radicals that cause a spark. The gas ignites and initiates the combustion. The window is a thick sapphire window. The laser beam lasts for less than ten nanoseconds.

In one form of the invention cylindrical chamber has inlets for natural gas and air. A piston extends from the chamber and is mounted in the chamber for axial movement. The piston has an inner end in the chamber and an outer end outside of the chamber. The piston has a die on the outer end for compaction of a part when the piston is driven in an outward direction from the chamber by rapid combustion of an air and natural gas mixture in the chamber. A thick sapphire window is in an end of the chamber opposite the piston. A laser source is spaced from the end of the chamber and the window. A laser beam focuser and director between the laser source and the window directs and focuses a laser beam through the window into the chamber in a fine line, or to a focused point in, a center of the chamber. This ignites the air and natural gas mixture in the chamber and initiates combustion. The piston is driven outward from the chamber, and the part is compacted. One laser beam director and focuser is a lens focusing the laser beam into a point in the center of the chamber. Another director and focuser is a collimator that focuses the laser beam in a fine line through the center of the chamber. A light absorber or diffuser is aligned with the center of the chamber opposite the window and absorbs or diffuses the laser beam at the piston.

The new method fills the chamber with a combustible gas and air mixture and pressurizes the chamber with the combustible gas and air mixture. The pressure moves the piston and the attached die to initially compress a part. The laser beam is focused with an optical device through the window into a point or fine line in a center of the chamber. The gas and air mixture in the chamber ignite and combust, which rapidly drives the piston and the die into the part and compacts the part.

The laser beam is on for less than 10 nanoseconds. A light diffuser on the piston diffuses the laser beam and prevents retro reflection of the laser beam and prevents contact of reflections from the laser beam on walls of the chamber.

A light absorber on the piston absorbs energy from the laser beam and prevents retro reflection of the laser beam and prevents reflections of the laser beam contacting walls of the chamber.

These and further and other objects and features of the invention are apparent in the disclosure, which include the above and ongoing written specification, with the claims and the drawings.

DETAILED DESCRIPTION OF THE DRAWINGS

Figures 1, 1A:
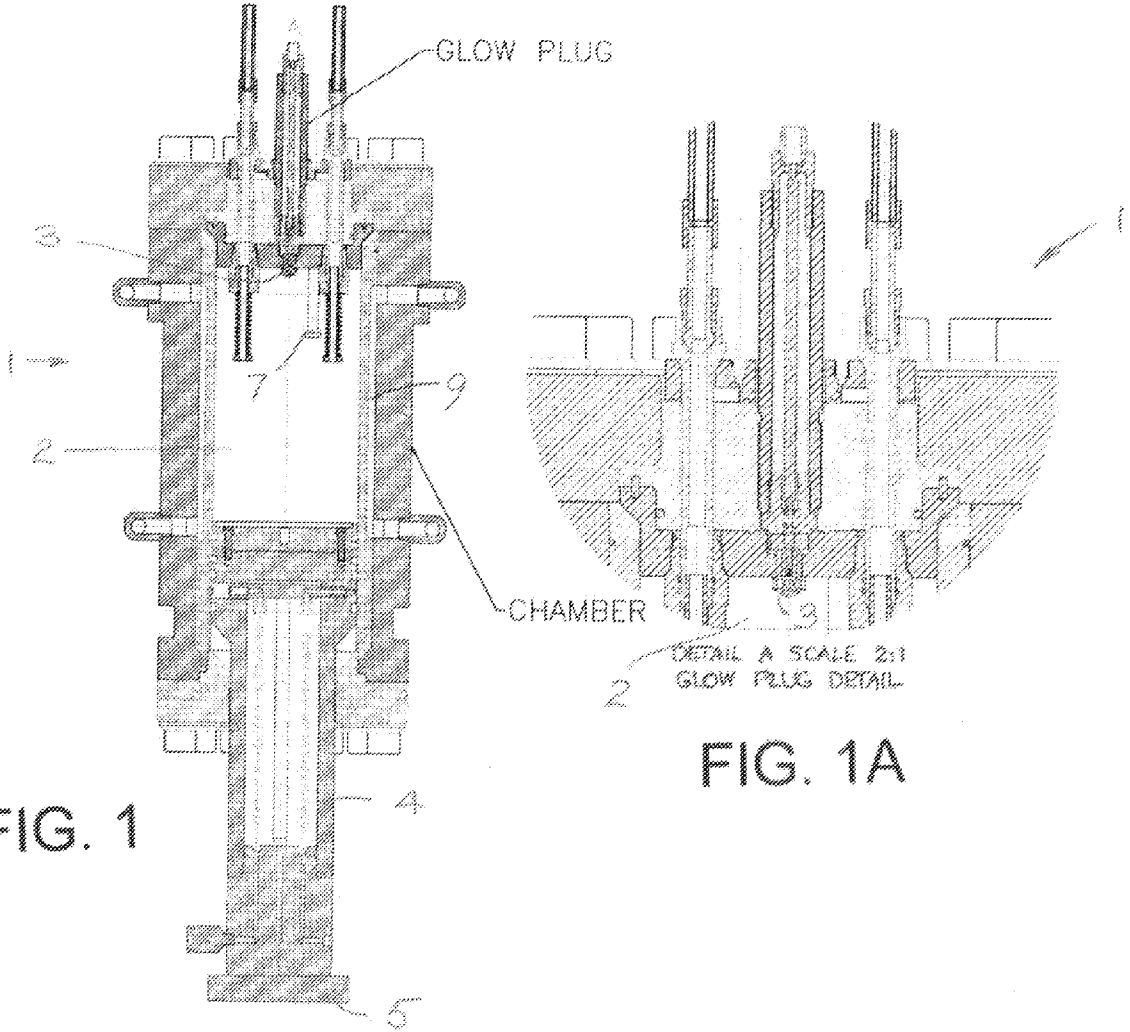
FIG. 1 shows a cross section of a press with a previous system using a glow plug to ignite the gas mixture in the chamber. The piston at the bottom compresses the target.
FIG. 1A is a cross sectional detail of the glow plug.

FIG. 1 shows a cross section of a press with a previous system using a glow plug to ignite the gas mixture in the chamber. The piston at the bottom compresses the target. A dynamic compression press 1 has a combustion chamber 2, which is shown expanded by the gas filling the chamber at high pressure having moved the ram against the target part before combustion is initiated by glow plug 3. During combustion, the ram 4 is driven on die 5 to shape the part. Chamber 2 is filled with combustible gas and oxygen through inlets 7 at a high pressure. As the filling pressure is increased in chamber 2, the ram 4 is pressed toward the die 5, pre-compressing grains and molecules of the powdered material to be formed into the part. Air and gases escape from the material during the pre-compression. When the combustible gas and oxygen reach the pre-determined filling pressure in chamber 2, inlets 7 are closed and the glow plug is energized to initiate combustion of the gases. The combustion increases pressure in the chamber 2 to about 150 tsi. The dramatically increased pressure in the chamber drives the ram 4 further toward the die 5 forming the interposed part in net shape and increasing its density and strength.

FIG. 1A is a cross sectional detail of the glow plug. During combustion, temperatures in the chamber 2 increase to about 3000K. A cooling jacket 9 is provided around the walls of the chamber 2. Following combustion and driving of the ram 4 to shape the part, the ram is raised. Scavenger ports 11 are opened, and combustion gases exit the chamber. A new green blank is placed on or in the die 5 and the gas filling, gas pre-compression, combustion and compacting steps are repeated.

As shown in the FIG. 1A detail the glow plug 3 is exposed to high pressures and temperatures in the chamber 2. Stress on the glow plug requires frequent replacement of the plug.

Figure 2:
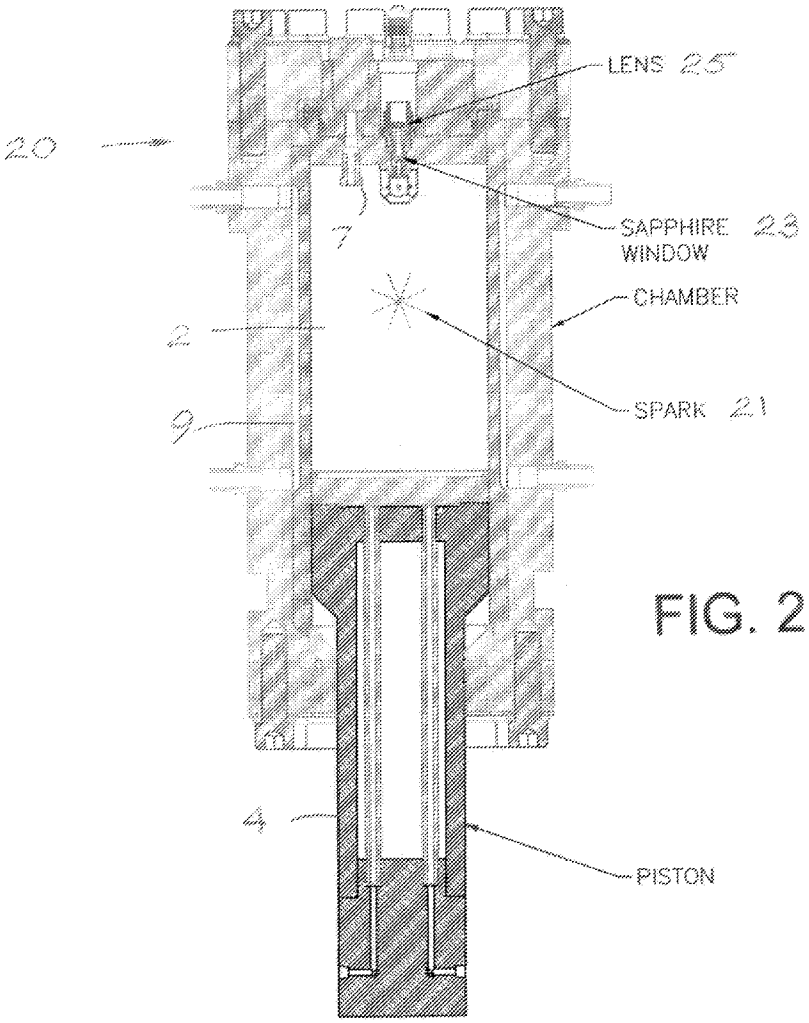
FIG. 2 shows a cross section of a new combustion chamber with a sapphire window to let the laser beam into the chamber and a lens behind the window to focus the laser beam into a point within a center of the chamber. The laser is mounted away from the chamber.

FIG. 2 shows a cross section of a new combustion chamber with a sapphire window to let the laser beam into the chamber and a lens behind the window to focus the laser beam into a point within a center of the chamber. The laser is mounted away from the chamber. In press 20 shown in FIG. 2, the glow plug 3 is replaced by a sapphire window 23 and a lens 25. A laser is mounted away from the press and chamber structure. The laser is in optical communication with the lens 25 and sapphire window 23. The lens focuses a laser beam to a point represented by a spark 21 in the center of the center of the chamber 2. The focused laser ignites the gas, and combustion proceeds outward driving the ram 4 outward towards the die 5, shown in FIG. 1.

The movement of the ram 2 during filling of the chamber produces the same pre-compression of the part. However, combustion is initiated by the spark 21 caused by the focused laser beam with a pulse duration of less than 10 nanoseconds.

Figure 3:
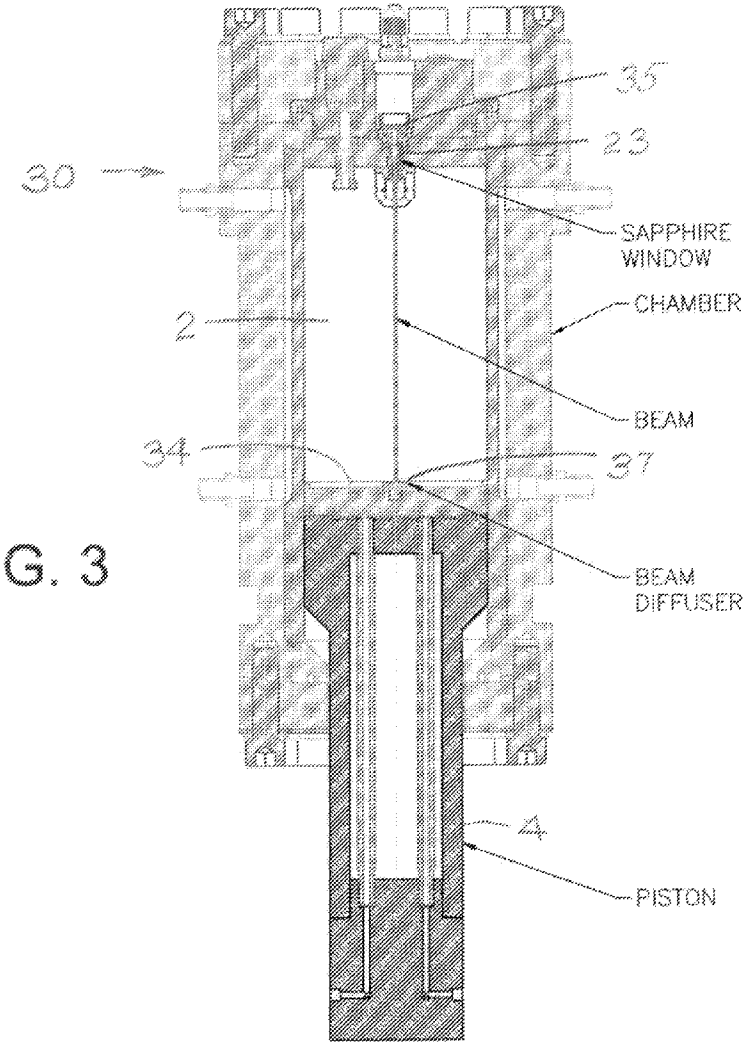
FIG. 3 shows a cross section of a new combustion chamber with a sapphire window to let the laser beam into the chamber and a collimator behind the window to concentrate the beam in a fine line. A diffuser at the opposite end of the chamber from the window prevents retro reflection through the window or reflection of the beam to superheat wall areas of the chamber.

FIG. 3 shows a cross section of a new combustion chamber with a sapphire window to let the laser beam into the chamber, and a lens behind the window. The laser is mounted away from the chamber. The structure of the press 30 shown in FIG. 3 is the same as the structure of press 20 shown in FIG. 2 with the exception that a collimator 35 replaces lens 25. The collimator produces a thin fine line of laser in a 10 ns pulse, which initiates gas ignition energy at points along the entire center axis of the chamber.

A laser beam diffuser 37 on top 34 of ram 4 at the bottom of the chamber 2 diffuses the laser beam and prevents retro reflection of the beam which might damage the laser or point reflections of the beam on the side walls which might cause detonation of the gaseous mixture in the chamber.

While the invention has been described with reference to specific embodiments, modifications and variations of the invention may be constructed without departing from the scope of the invention, which is defined in the following claims.

We claim:

1. Apparatus comprising a combustion driven compaction press having a combustion chamber, a piston in and extending from the chamber, a die connected to an end of the piston remote from the chamber, gas and air inlets connected to the chamber for filling and pressurizing the chamber with a gas and air mixture and moving the piston and die to initially compress a near net shape part, a laser source spaced from the chamber for projecting a laser beam, an optical device optically aligned with the laser source for focusing the laser beam and directing the laser beam toward the chamber, a window in the chamber opposite the piston for admitting the focused and directed laser beam into the chamber for igniting the gas and air mixture and initiating combustion of the gas and air mixture in the chamber and driving the piston and die outward to compact the part to near net shape, wherein the optical device comprises a lens for focusing the laser beam to a focal point within the chamber, and wherein the lens focuses the focal point in a center of the chamber.

2. The apparatus of claim 1, wherein the laser source provides the laser beam that intensely heats the gas and air at a focus for the igniting the gas and air mixture and initiating the combustion.

3. The apparatus of claim 1, wherein the laser source provides the laser source beam that produces photons that do not heat the gas but disassociate molecules and create radicals that ignite the gas and air mixture and initiate and start the combustion.

4. The apparatus of claim 1, wherein the window is a thick sapphire window.

5. The apparatus of claim 1, wherein the laser beam lasts for less than ten nanoseconds.

6. A method of using the apparatus of claim 1, the method comprising: filling the chamber with a combustible gas and air mixture, pressurizing the chamber with the combustible gas and air mixture, moving the piston and the die attached to the piston with the combustible gas and air mixture and compressing a part, focusing the laser beam with the optical device through the window into a point or fine line in a center of the chamber, igniting and combusting the gas and air mixture in the chamber, driving the piston and the die into the part and compacting the part.

7. Apparatus comprising a cylindrical chamber, inlets for natural gas and air connected to the chamber for producing a pressurized natural gas and air mixture in the chamber, a piston extending from the chamber and mounted for axial movement in the chamber, the piston having an inner end in the chamber and an outer end outside of the chamber, a die on the outer end of the piston for compressing a near net shape part when the cylinder is pressurized natural gas and air mixture and for compacting the part when the piston is driven in an outward direction from the chamber by rapid combustion of an air and natural gas mixture in the chamber, a thick sapphire window in an end of the chamber opposite the piston, a laser source spaced from the end of the chamber and spaced from the window, a laser beam focuser and director between the laser source and the window for focusing and directing a laser beam from the laser source through the window into the chamber in a fine line or a focused point in a center of the chamber for igniting the air and natural gas mixture in the chamber and initiating combustion to drive the piston of the air and natural gas mixture and the die outward from the chamber to compact the part.

8. The apparatus of claim 7, wherein the optical device comprises a collimator for focusing the laser beam to a fine line through the window.

9. The apparatus of claim 7, wherein the collimator focuses the laser beam in the fine line that is on a center line of the chamber.

10. The apparatus of claim 9, wherein the chamber is a cylindrical chamber.

11. The apparatus of claim 9, further comprising a light absorber or a light diffuser on the piston in the chamber opposite the window for absorbing energy of the laser beam or for diffusing the laser beam, preventing retro reflection of the laser beam through the window and preventing ignition of the gas and air mixture elsewhere than in the center of the chamber.

12. The apparatus of claim 7, wherein the laser beam focuser and director is a lens focusing the laser beam into a point in the center of the chamber.

13. The apparatus of claim 7, wherein the laser beam focuser and director is a collimator focusing the laser beam in a fine line through the center of the chamber, and further comprising a light absorber or diffuser on the piston, wherein the light absorber or diffuser is aligned with the center of the chamber opposite the window for absorbing or diffusing the laser beam at the piston.

14. A method comprising filling a chamber with a combustible gas and air mixture, pressurizing the chamber with the combustible gas and air mixture, moving a piston and the die attached to the piston outward with the pressurized gas and air mixture and compressing a near net shape part, focusing a laser beam with an optical device through a window in the chamber into a point or fine line in a center of the chamber, igniting the gas and air mixture in the chamber, with the focused laser beam and combusting the gas and air mixture and rapidly driving the piston and the die with combustion product gases into the part and compacting the part.

15. The method of claim 14, further comprising providing the laser beam for less than 10 nanoseconds.

16. The method of claim 14, further comprising providing a light diffuser on the piston, diffusing the laser beam with the diffuser, thereby preventing retro reflection of the laser beam and preventing reflections from the laser beam from contacting walls of the chamber.

17. The method of claim 14, further comprising providing a light absorber on the piston, absorbing energy from the laser beam with the diffuser and preventing retro reflection of the laser beam and preventing reflections of the laser beam from contacting walls of the chamber.

* * * * *